US005711180A

United States Patent [19]

Sasahara et al.

[11] Patent Number: 5,711,180

[45] Date of Patent: Jan. 27, 1998

[54] PRESSING CAM DIE

[75] Inventors: Tadashi Sasahara; Hideyuki Morioka, both of Fujisawa, Japan

[73] Assignee: Oiles Corporation, Tokyo, Japan

[21] Appl. No.: 629,046

[22] Filed: Apr. 8, 1996

[51] Int. Cl.[6] ..... B21D 5/04

[52] U.S. Cl. ..... 72/381; 72/304; 72/315; 72/452.9; 83/635

[58] Field of Search ..... 72/304, 313, 314, 72/315, 381, 383, 452.9; 83/588, 623, 635

[56] References Cited

U.S. PATENT DOCUMENTS

| | | | |
|---|---|---|---|
| 4,471,680 | 9/1984 | Gerhart | 83/588 |
| 5,101,705 | 4/1992 | Matsuoka | 72/452.9 |
| 5,269,167 | 12/1993 | Gerhart | 72/381 |
| 5,487,296 | 1/1996 | Gerhart et al. | 72/381 |

FOREIGN PATENT DOCUMENTS 4-344839 12/1992 Japan .

*Primary Examiner*—David Jones
*Attorney, Agent, or Firm*—Nixon & Vanderhye

[57] ABSTRACT

A pressing cam die includes a cam slide having a cam surface; a supporting device for supporting the cam slide onto an upper die such that the cam slide is movable in a downwardly inclined direction; a coil spring for urging the cam slide toward its initial position; and a cam driver having a cam surface which is slidably brought into surface contact with the cam surface of the cam slide. The supporting device has a base and a round guide bar which is attached to a front wall portion and a rear wall portion of the base. The coil spring is wound around the guide bar and is disposed concentrically with the guide bar.

5 Claims, 5 Drawing Sheets

PRESSING CAM DIE

BACKGROUND OF THE INVENTION

The present invention relates to a pressing cam die for effecting working such as punching, shearing, and bending by converting a pressurizing force of a press machine in a downward direction or the like into a diagonally downward direction or the like which intersects the same, by making use of a cam having an inclined cam surface.

In a pressing cam die of this type, a cam slide having a cam surface inclined in such a manner as to face a diagonally downward direction is movably supported by an upper die of a press machine, while a cam driver having a cam surface inclined in such a manner as to face a diagonally upward direction is fixed to a lower die of the press machine. The cam slide is lowered toward the cam driver to cause the cam surface of the cam slide to abut against the cam surface of the cam driver. As the cam surface of the cam slide slides on the cam surface of the cam driver, the cam slide is moved in a diagonally downward direction which intersects the downward direction, so as to simultaneously effect an operation, such as punching, with respect to a workpiece being pressed, by a tool attached to a tip of the cam slide.

The above-described pressing cam die is provided with a supporting mechanism for movably supporting the cam slide by the upper die of the press machine as well as a coil spring for returning the cam slide to its initial position. However, since the supporting mechanism and the coil spring are disposed in two stages arranged vertically, the cam slide becomes high. As a result, the space for installing the pressing cam die becomes large, so that there is a problem in that it is difficult to install the pressing cam die in a narrow installation space.

SUMMARY OF THE INVENTION

The present invention has been accomplished in view of the above-described problems, and an object of the present invention is to provide a pressing cam die the overall height of which can be lowered and which can be easily installed in a narrow installation space.

In accordance with the present invention, the above object can be attained by a pressing cam die comprising: a cam slide having an inclined cam surface and a through hole; supporting means for movably supporting the cam slide, the supporting means having a base and a guide bar passed through the through hole in the cam slide and supported by the base; spring means for urging the cam slide toward an initial position, the spring means having a coil spring disposed by being wound around the guide bar of the supporting means so as to urge the cam slide toward the initial position; and a cam driver having a cam surface which is slidably brought into surface contact with the cam surface of the cam slide.

In a preferred example of the present invention, a bush whose outer peripheral surface is secured to the cam slide and whose inner peripheral surface slidably abuts against an outer peripheral surface of the guide bar is disposed in the through hole of the cam slide through which the guide bar is passed. As the guide bar, it is possible to use a cylindrical (round) guide bar, a prismatic guide bar, an elliptical guide bar, or the like, or one having a dovetail projection or groove which is slidably fitted to a dovetail groove or projection formed in the cam slide. In a case where the guide bar is constituted by the prismatic guide bar, the elliptical guide bar, or the one having the dovetail projection or groove, the rotation of the cam slide itself can be prevented by the same.

Alternatively, however, a guide surface may be formed on the base so as to guide the movement of the cam slide as one end surface of the cam slide, such as an upper or lower surface thereof, is slidably brought into contact with the guide surface, and to prevent the rotation of the cam slide about the guide bar.

In a preferred example, the base has a front wall portion, a rear wall portion, and a connecting wall portion for connecting the front wall portion and the rear wall portion, the guide bar has one end attached to the front wall portion and another end attached to the rear wall portion, a recess is formed on a front surface of the cam slide facing the front wall portion, and the coil spring is disposed between a bottom surface of the recess and the front wall portion.

The base may be secured to the upper die side or the lower die side, and the cam driver is secured to the lower die side or the upper die side correspondingly. In addition, the guide bar may be disposed horizontally or in an inclined manner. It should be noted that, in accordance with the present invention, a forcibly returning mechanism may be further provided in addition to the above-described arrangement. This forcibly returning mechanism acts in such a manner as to allow the cam slide to return to its initial position reliably.

In the pressing cam die in accordance with the present invention, the cam driver is secured to, for example, a base or the like of the lower die, and the cam slide is attached to the upper die by means of the supporting means. The cam slide is lowered toward the cam driver as the ram of a press machine is operated. During this lowering stroke, the cam slide is brought into contact with the cam driver. As the cam slide is thus brought into contact with the cam driver, the cam slide disposed in the initial position by the spring means is slid diagonally downward while being guided by the cam surface of the cam driver. Consequently, punching, for example, is carried out by a tool provided at the tip of the cam slide. After the punching operation, the cam slide is raised, with the result that the aforementioned contact is canceled, and the cam slide is returned to the initial position by being urged by the spring means.

As described above, in accordance with the present invention, the overall height of the pressing cam die can be lowered, so that the pressing cam die can be easily installed in a narrow installation space. In addition, the guide pin of the coil spring itself, serving as the spring means, can be omitted. Furthermore, the configuration of the overall coil spring can be maintained by the guide bar, so that a portion of the coil spring is placed between the guide pin and the cam slide and the like during operation, thereby making it possible to obviate a situation in which the coil spring becomes damaged.

Hereafter, a more detailed description of the present invention will be given on the basis of preferred embodiments shown in the drawings. It should be noted that the present invention is not restricted to the embodiments.

DESCRIPTION OF THE PREFERRED EMBODIMENTS

Figure 1:
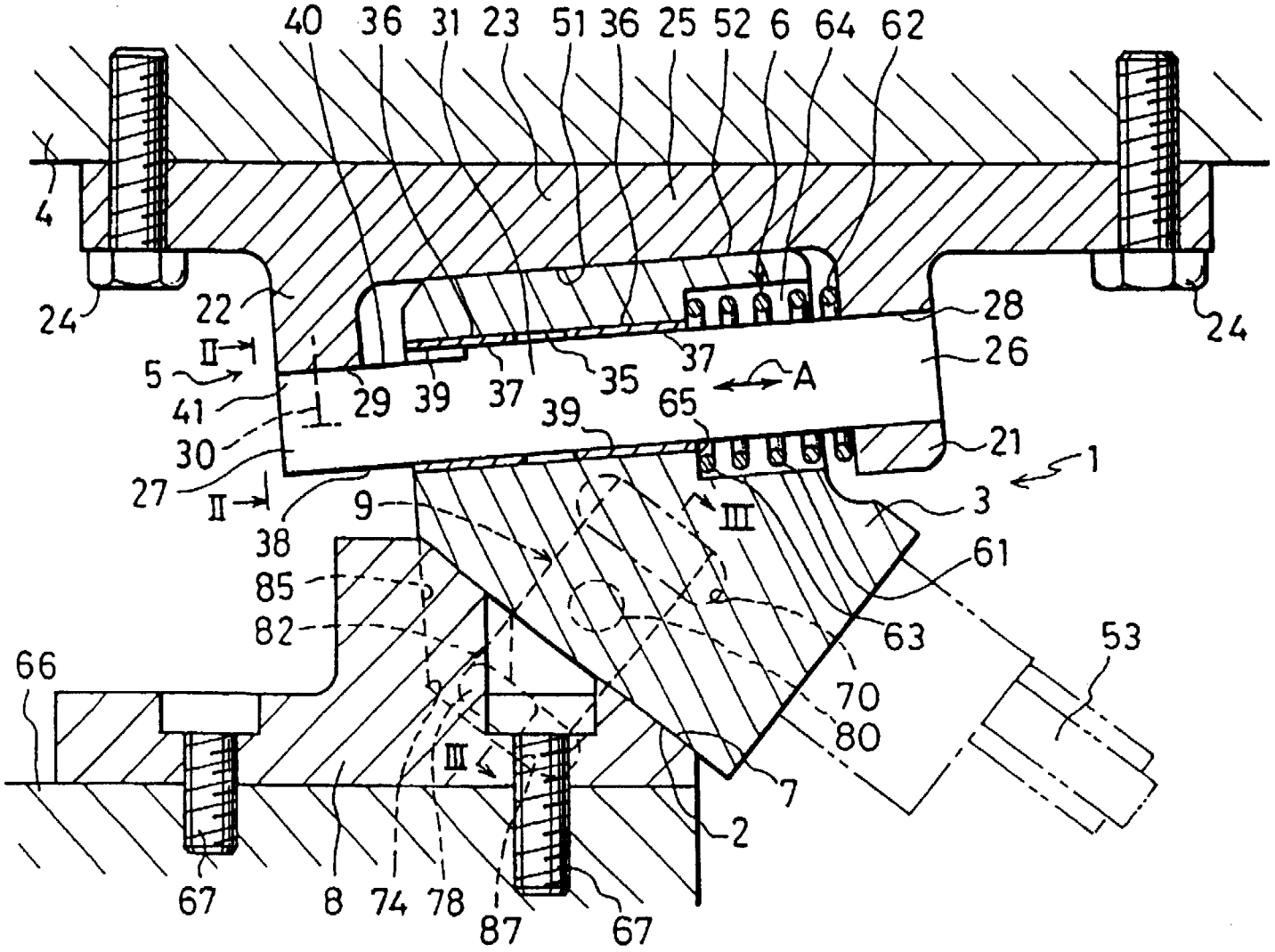
FIG. 1 is an explanatory cross-sectional view of a preferred embodiment of the present invention.
Figure 2:
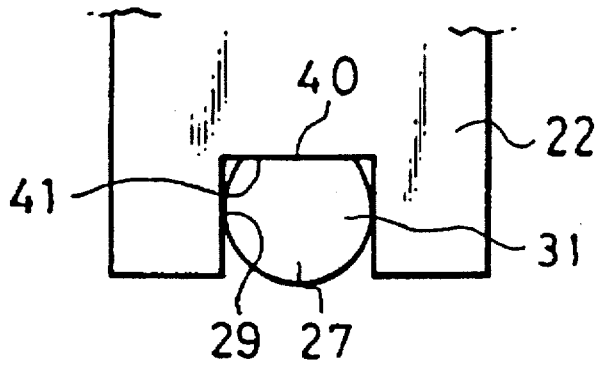
FIG. 2 is a view of the embodiment shown in FIG. 1, taken in the direction of arrows along line II—II.
Figure 3:
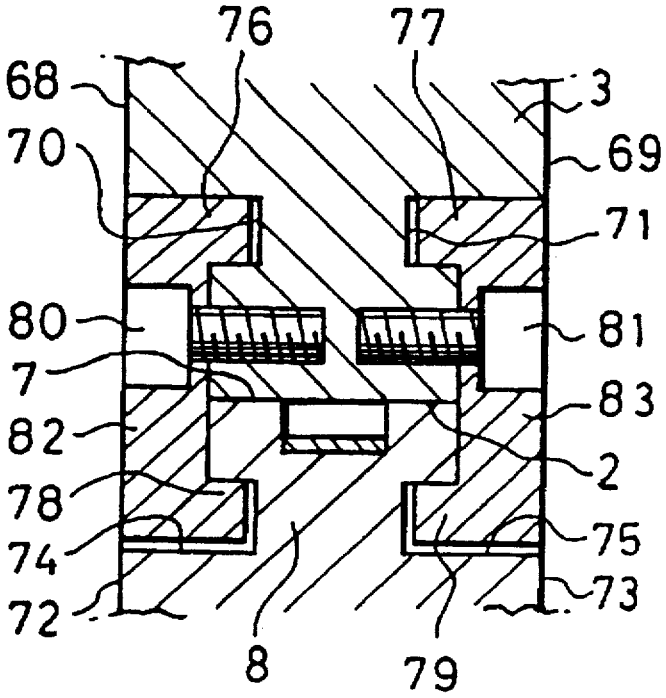
FIG. 3 is a cross-sectional view of the embodiment shown in FIG. 1, taken along line III—III.

In FIGS. 1 to 4, a pressing cam die 1 in this example is comprised of a cam slide 3 having a cam surface 2 inclined in such a manner as to face a diagonally downward direction; a supporting means 5 for supporting the cam slide 3 onto an upper die 4 such that the cam slide 3 is movable in the direction of A; a spring means 6 for urging the cam slide 3 toward its initial position; a cam driver 8 having a cam surface 7 which is inclined in such a manner as to face a diagonally upward direction and is slidably brought into surface contact with the cam surface 2 of the cam slide 3; and a forcibly returning mechanism 9 for forcibly returning the cam slide 3 to its initial position.

The supporting means 5 is provided with a base 25 which integrally has a front wall portion 21, a rear wall portion 22, and an upper wall portion 23 serving as a connecting wall portion for connecting the front wall portion 21 and the rear wall portion 22, the base 25 being fixed to the upper die 4 at the upper wall portion 23 by means of bolts 24; a round guide bar 31 whose opposite ends 26 and 27 are respectively inserted and fitted in a through hole 28 and a recess 29 formed in the front wall portion 21 and the rear wall portion 22, and are respectively attached to the front wall portion 21 and the rear wall portion 22 by means of a screw 30 or the like. The guide bar 31 is passed through a through hole 35 formed in the cam slide 3, and supports the cam slide 3 movably in the direction of A. Disposed in the through hole 35 is a bush 39 whose outer peripheral surface 36 is secured to the cam slide 3 and whose inner peripheral surface 37 slidably abuts against an outer peripheral surface 38 of the guide bar 31. Incidentally, to ensure that the guide bar 31 does not rotate with respect to the base 25, a flat surface 40 is formed at one end 27 of the guide bar 31, and a bottom surface 41 of the recess 29 is also formed as a flat surface in correspondence with the flat surface 40.

Figure 5:
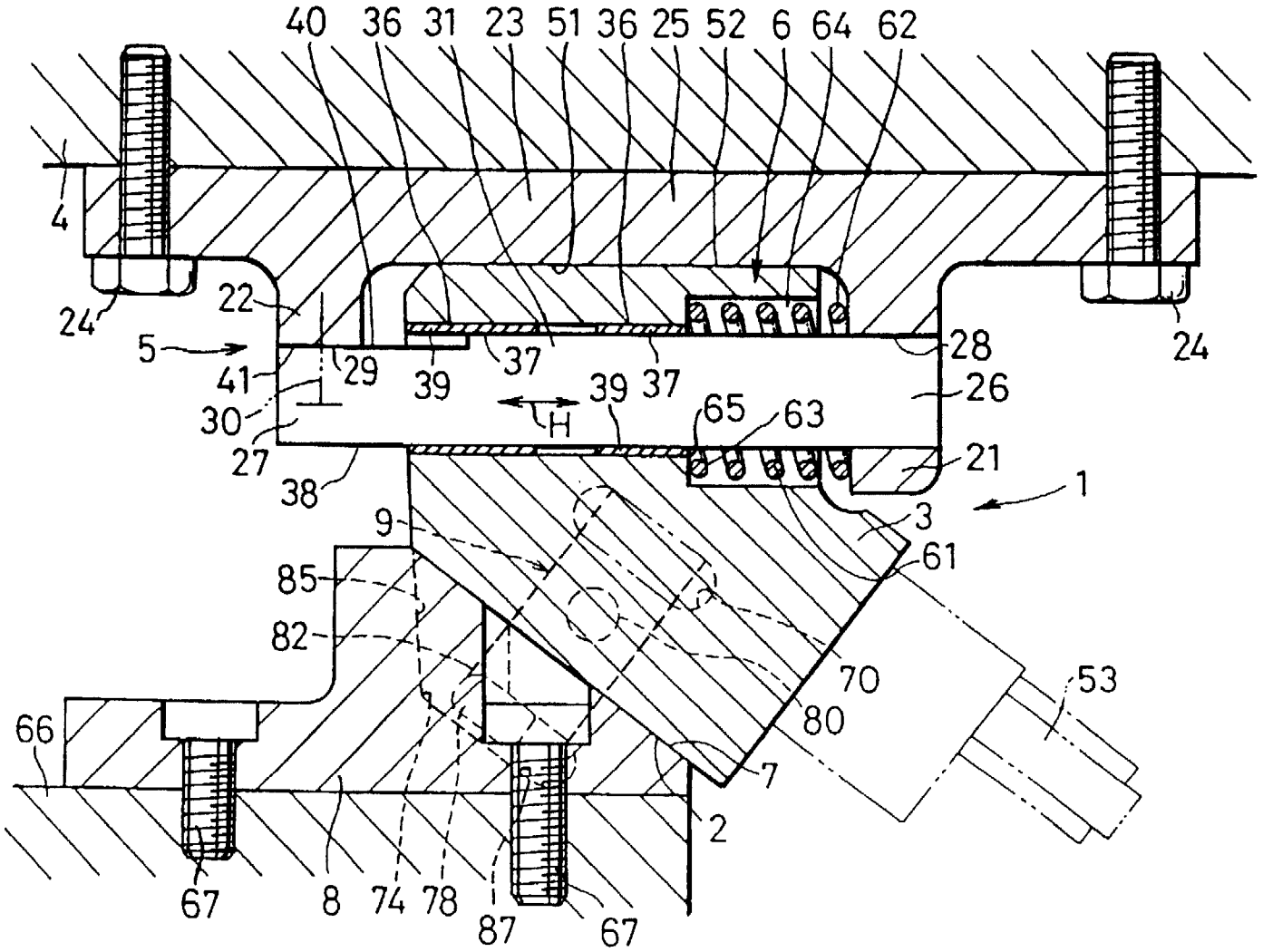
FIG. 5 an explanatory cross-sectional view of another preferred embodiment of the present invention.

The cam slide 3 has a flat upper surface 52 extending in an inclined manner as one end surface which slidably abuts against a flat guide surface 51 of the upper wall portion 23 of the base plate 25, the flat guide surface 51 similarly extending in an inclined manner. In operation, the cam slide 3 moves in the direction of A while being guided by the guide surface 51. Incidentally, although in this example the direction of A is oriented slightly diagonally upward with respect to the horizontal direction, the present invention is not necessarily limited to the same. For instance, an arrangement may be provided as shown in FIG. 5 in which the guide bar 31, the guide surface 51, the upper surface 52, and the like are disposed in the horizontal direction, and the cam slide 3 is moved in the direction of H which is the horizontal direction. A punching tool 53 or the like is attached to the tip of the cam slide 3.

The spring means 6 is constituted by a coil spring 61 which is wound around the guide bar 31 and is disposed concentrically with the guide bar 31. The coil spring 61 has one end 62 abutting against the front wall portion 21 of the base 25 and the other end 63 abutting against a bottom surface 65 of a circular recess 64 formed on the front surface of the cam slide 3, and is disposed between the front wall portion 21 and the bottom surface 65 of the recess 64. The cam slide 3 in its initial position abuts against the rear wall portion 22 of the base 25 by means of the spring force of the coil spring 61. The cam driver 8 is secured to a base 66 of a lower die by means of screws 67 or the like.

The forcibly returning mechanism 9 is provided with inclined elongated grooves 70 and 71 which are respectively formed on side surfaces 68 and 69 of the cam slide 3; bent grooves 74 and 75 which are respectively formed on side surfaces 72 and 73 of the cam driver 8; and engaging members 82 and 83 which are respectively secured to the side surfaces 68 and 69 of the cam slide 3 by means of screws 80 and 81, the engaging members 82 and 83 respectively having at one ends thereof projections 76 and 77 fitted in the elongated grooves 70 and 71 and having at the other ends thereof projections 78 and 79 capable of engaging with the bent grooves 74 and 75. The bent grooves 74 and 75 respectively consist of vertical groove portions 85 and 86 which open at the cam surface 7 of the cam driver 8 as well as inclined groove portions 87 and 88 respectively communicating with the vertical groove portions 85 and 86.

A description will be given of the operation of the pressing cam die 1 which is formed as described above.

Figure 4:
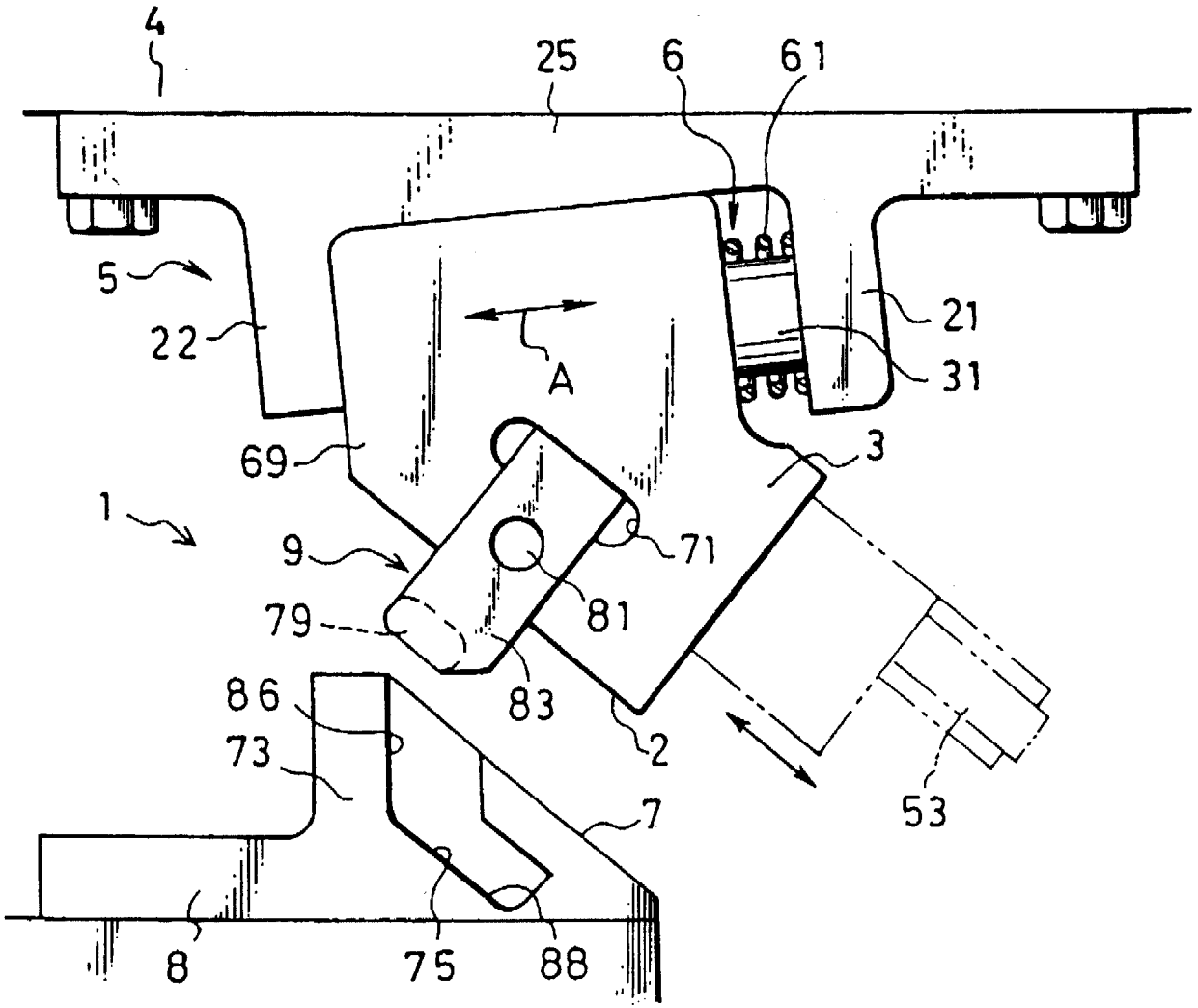
FIG. 4 is a diagram illustrating the operation of the embodiment shown in FIG. 1.

First, in the initial position shown in FIG. 4, the upper die 4 and the cam slide 3 are located in an upper position, and the cam slide 3 abuts against the rear wall portion 22 of the base 25 by being urged by the coil spring 61. If a ram of the press machine is operated in this state, the upper die 4 and the cam slide 3 are lowered. As the upper die 4 and the cam slide 3 are lowered, the respective projections 78 and 79 of the engaging members 82 and 82 enter the vertical groove portions 85 and 86. As the upper die 4 and the cam slide 3 are further lowered, the cam surface 2 of the cam slide 3 is brought into contact with the cam surface 7 of the cam driver 8. As a result, the cam slide 3 is lowered while being guided by the cam surface 7 through the surface contact of the cam surfaces 2 and 7, and slides in the direction of A against the resilient force of the coil spring 61. Thus the cam slide 3 pushes out the punching tool 53 toward the workpiece, so that punching is effected with respect to the workpiece by the punching tool 53. Incidentally, through the lowering of the cam slide 3 and the sliding movement thereof in the direction of A, the projections 78 and 79 of the engaging members 82 and 83 are respectively passed through the vertical groove portions 85 and 86 and are then respectively disposed in the inclined groove portions 87 and 88.

After this punching, through the action of the ram of the press machine which is reverse to the above-described action, reverse operation to the above-described operation is carried out, and the upper die 4 and the cam slide 3 are raised. During this raising, the cam slide 3 which is urged by the coil spring 61 is returned to the initial position while being guided by the guide surface 51. The above-described operation is repeated with new workpieces.

In the pressing cam die 1, since the coil spring 61 of the spring means 6 is wound around the guide bar 31, and is disposed concentrically with the guide bar 31, the height of the pressing cam die 1 can be lowered as compared with the conventional pressing cam die. In addition, since the guide pin of the coil spring 61 can be substituted by the guide bar 31, it is possible to attain a reduction in cost.

Figure 6:
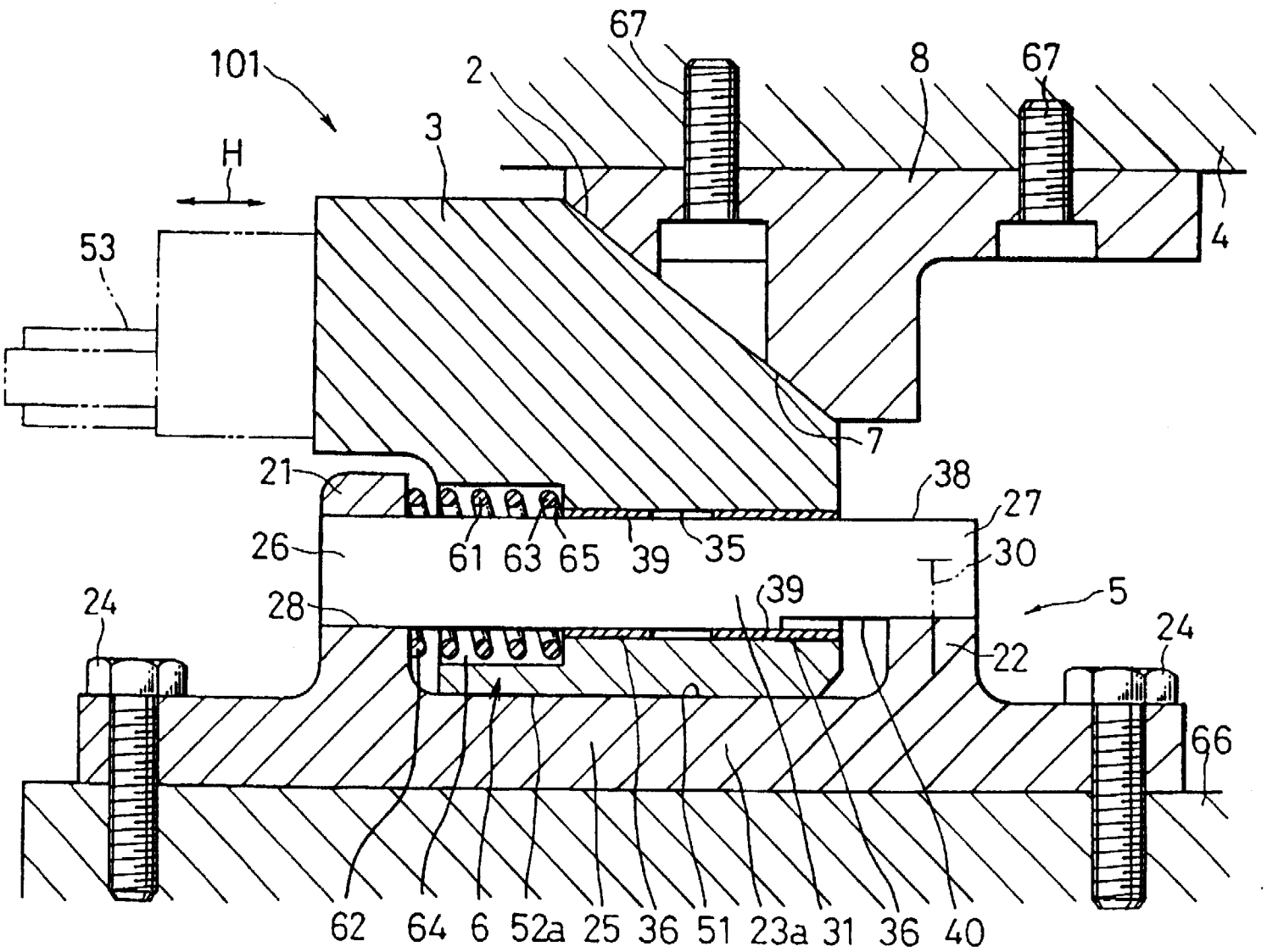
FIG. 6 an explanatory cross-sectional view of a further preferred embodiment of the present invention.

In the above-described example, a description has been given of the pressing cam die in which the cam driver 8 is mounted on the lower die side, and the punching tool 53 is made to project diagonally downward. Alternatively, as shown in FIG. 6, the present invention may be applied to a pressing cam die 101 in which the cam driver 8 is mounted on the upper die 4 side, and the cam slide 3 is mounted on the lower die side, so as to project the punching tool 53 in the direction of H which is the horizontal direction. That is, the pressing cam die 101 shown in FIG. 6 is comprised of the cam slide 3 having the cam surface 2 inclined in such a manner as to face a diagonally upward direction; the supporting means 5 for supporting the cam slide 3 onto the base 66 of the lower die such that the cam slide 3 is movable in the direction of H; the spring means 6 for urging the cam slide 3 toward its initial position; the cam driver 8 having the cam surface 7 which is inclined in such a manner as to face a diagonally downward direction and is slidably brought into surface contact with the cam surface 2 of the cam slide 3, the cam driver 8 being secured to the upper die 4; and the forcibly returning mechanism (not shown) for forcibly returning the cam slide 3 to its initial position. The round guide bar 31 of the supporting means 5 is arranged in such a manner as to extend horizontally, is passed through the through hole 35 formed in the cam slide 3, and supports the cam slide 3 such that the cam slide 3 is movable in the direction of H. The base 25 has a bottom wall portion 23*a* as a connecting wall between the front wall portion 21 and the rear wall portion 22, and the cam slide 3 has a flat lower surface 52*a* extending horizontally as one end surface which slidably abuts against the flat horizontally extending guide surface 51 of the bottom wall portion 23*a*. The other arrangement of the pressing cam die 101 is similar to that of the above-described example, so that portions of the same arrangement are denoted by the same reference numerals, and a description thereof will be omitted.

The pressing cam die 101 also operates in a manner similar to the pressing cam die 1. In addition, since the coil spring 61 of the spring means 6 is wound around the guide bar 31, and is disposed concentrically with the guide bar 31, the height of the pressing cam die 101 can be lowered as compared with the conventional pressing cam die. Furthermore, since the guide pin of the coil spring 61 can be substituted by the guide bar 31, it is possible to attain a reduction in cost.

What is claimed is:

1. A pressing cam die comprising:

a cam slide having an inclined cam surface, a through hole, and a recess communicating at a bottom surface thereof with said through hole, said recess being larger in diameter thereof than that of said through hole;

supporting means for movably supporting said cam slide, said supporting means including a base having a guide plane surface for guiding movement of said cam slide, a front wall portion, a rear wall portion, and a connecting wall portion for connecting said front wall portion and said rear wall portion, said cam slide having at one end thereof a plane surface which is slidably brought into direct contact with said guide plane surface of the base;

a guide bar passing through the through hole and said recess of said cam slide and supported by said base, said guide bar having one end attached to said front wall portion, and said coil spring being disposed between said bottom surface of said recess and said front wall portion;

spring means for urging said cam slide toward an initial position, said spring mean having a coil spring disposed by being wound around said guide bar of said supporting means so as to urge said cam slide toward the initial position, said coil spring having one end portion disposed within said recess of the cam slide;

a cam driver having a cam surface which is slidably brought into surface contact with the cam surface of said earn slide; and a bush whose outer peripheral surface is secured to said cam slide and whose inner peripheral surface slidably abuts against an outer peripheral surface of said guide bar, said bush being disposed in the through hole of said cam slide through which said guide bar passes.

2. A pressing cam die according to claim 1, wherein said base is secured to an upper die, and said cam driver is secured to a lower die.

3. A pressing cam die according to claim 1, wherein said base is secured to a lower die side, and said cam driver is secured to an upper die side.

4. A pressing can die according to claim 1, wherein said guide bar is disposed horizontally.

5. A pressing cam die according to claim 1, wherein said guide bar is inclined.

* * * * *

UNITED STATES PATENT AND TRADEMARK OFFICE

CERTIFICATE OF CORRECTION

PATENT NO. : 5,711,180

DATED : Jan. 27, 1998

INVENTOR(S) : Sasahara, et al

It is certified that error appears in the above-identified patent and that said Letters Patent is hereby corrected as shown below:

Column 6, line 24, delete "earn" and replace by —cam—

Signed and Sealed this

Twenty-first Day of April, 1998

Bruce Lehman

*Attest:*

BRUCE LEHMAN

*Attesting Officer*

*Commissioner of Patents and Trademarks*